US007028369B2

(12) United States Patent
Park et al.

(10) Patent No.: US 7,028,369 B2
(45) Date of Patent: Apr. 18, 2006

(54) COMBINATION WET AND DRY TYPE VACUUM CLEANER

(75) Inventors: Joung-soo Park, Jeongeup (KR); Ki-man Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 436 days.

(21) Appl. No.: 10/369,918

(22) Filed: Feb. 20, 2003

(65) Prior Publication Data

US 2004/0055105 A1 Mar. 25, 2004

(51) Int. Cl.
*A47L 5/36* (2006.01)

(52) U.S. Cl. ..... 15/353; 15/327.2; 15/339

(58) Field of Classification Search ..... 15/327.1, 15/327.2, 327.6, 327.7, 353
See application file for complete search history.

(56) References Cited

U.S. PATENT DOCUMENTS

| | | | | | |
|---|---|---|---|---|---|
| 2,722,996 | A | * | 11/1955 | Seck et al. | 55/305 |
| 2,794,513 | A | * | 6/1957 | Hultberg et al. | 55/366 |
| 3,034,273 | A | | 5/1962 | Wallace | |
| 3,177,635 | A | * | 4/1965 | Cawl et al. | 96/421 |
| 3,180,071 | A | | 4/1965 | Nolte | |
| 3,320,727 | A | * | 5/1967 | Farley et al. | 55/337 |
| 3,343,199 | A | | 9/1967 | Nolte | |
| 4,167,800 | A | | 9/1979 | Tribolet | |
| 4,310,945 | A | * | 1/1982 | Tribolet | 15/347 |
| 4,463,474 | A | * | 8/1984 | Jacobs | 15/353 |
| 5,297,311 | A | * | 3/1994 | Puri | 15/347 |
| 5,343,592 | A | | 9/1994 | Parise | |
| 5,526,547 | A | | 6/1996 | Williams et al. | |
| 5,958,113 | A | * | 9/1999 | Collins et al. | 96/329 |
| 2005/0050677 | A1 | * | 3/2005 | Kim | 15/353 |

FOREIGN PATENT DOCUMENTS

| | | | |
|---|---|---|---|
| DE | 1282252 | | 11/1968 |
| DE | 1919651 | | 11/1969 |
| DE | 2856115 | * | 7/1980 |
| DE | 3006838 | | 9/1981 |
| DE | 8514495 | | 10/1986 |
| EP | 0297526 | | 1/1989 |
| EP | 0488014 | * | 6/1992 |
| JP | 502165 | | 1/1975 |
| JP | 5624 | | 1/1981 |
| JP | 108833 | | 7/1983 |
| JP | 23631 | | 1/1988 |
| WO | WO 0072739 | | 12/2000 |

* cited by examiner

*Primary Examiner*—Terrence R. Till
(74) *Attorney, Agent, or Firm*—Ladas & Parry LLP

(57) ABSTRACT

A wet/dry type vacuum cleaner has a suction generator, a cleaner body including the suction generator at one side of a lower portion, an intake port being connected with a nozzle that is movable along a surface to be cleaned, and a discharge port through which a clean air is discharged, a contaminant separator removably mounted in the cleaner body to separate contaminant-laden wet air drawn through the intake port into the contaminant and water components and air, and then to store the separated contaminant and water therein, a cover, being open and closed, disposed on an upper portion of the cleaner body to seal an upper opening of the cleaner body, and a discharge path opening a fluid communication between the contaminant separator and the discharge port, for the air separated at the contaminant separating means to be discharged out through the discharge port of the cleaner body. Since the suction generator is provided at the lower portion of the cleaner body instead of the upper portion, the cover can be constructed in a simple manner and a user can remove the contaminant receptacle by simply opening the cover and emptying the contaminant receptacle.

9 Claims, 5 Drawing Sheets

COMBINATION WET AND DRY TYPE VACUUM CLEANER

BACKGROUND OF THE INVENTION

1. Field of the Invention

The present invention relates generally to a vacuum cleaner, and more particularly, it relates to a wet and dry type vacuum cleaner for commercial use, capable of suctioning and filtering dry media, such as dust, and wet media, such as water.

2. Description of the Background Art

Generally, vacuum cleaners are categorized into wet type, dry type and combination wet and dry type vacuum cleaners.

The dry type vacuum cleaner performs cleaning operations with a device, such as a filter, that filters out dry media such as dust, and does not suction wet media. The wet type vacuum cleaner suctions wet media such as detergent and water, and it performs cleaning operations by spraying the wet media and suctioning the wet media and the contaminants entrained therein. The wet type vacuum cleaner has a device, such as a separating tank, for separating the air from the water, both of which are suctioned up into the vacuum cleaner. The wet and dry type vacuum cleaner has the combined function of the wet type vacuum cleaner and the dry type vacuum cleaner.

The wet/dry type vacuum cleaner includes a motor portion for generating suction, a nozzle portion for drawing in wet media such as water and the contaminants entrained therein, and a filtering portion for separating entrained air from the water and the contaminants, and a storage portion for storing the contaminants and water separated from the air.

U.S. Pat. No. 4,218,805 discloses an example of a conventional wet/dry type vacuum cleaner, which will be described briefly below with reference to FIG. 1.

Referring to FIG. 1, a reference numeral 1 denotes a reservoir. A power head unit 3, having a motor 2 for generating suction, is removably disposed on an upper portion of the reservoir 1. The power head unit 3 has a filter 4 disposed in a predetermined location inside of the reservoir 1, and the reservoir 1 is connected with a nozzle 5 for drawing into the vacuum cleaner body the water and the contaminants from a surface to be cleaned.

In the conventional wet/dry type vacuum cleaner, as the motor 2 of the power head unit 3 is driven, strong suction is generated inside of the reservoir 1, for suctioning the contaminants and the water into the reservoir 1 through the nozzle 5, together with air. The contaminants and the water are separated from the air and stored in the reservoir 1, while the clean air is discharged out via the motor 2. A detergent tank 6, from which a detergent is fed through the nozzle 5 during the cleaning operation, is disposed internally of the reservoir 1, as shown. Accordingly, the detergent is sprayed over the surface to be cleaned through the nozzle 5.

FIG. 2 shows another example of the conventional wet/dry vacuum cleaner. In FIG. 2, a reservoir 10 includes a power head unit 30 and a filter 40.

As shown, the power head unit 30 is removably mounted on the upper portion of the reservoir 10. Albeit not shown, the power head unit 30 is also provided with a motor for generating suction, as in the vacuum cleaner shown in FIG. 1. The filter 40 is mounted inside of the reservoir 10, and is supported by the upper rim of the reservoir 10.

During the cleaning operation, the motor of the power head unit 30 is driven, thereby generating strong suction inside the reservoir 10. Accordingly, contaminants, water and air are drawn into the reservoir 10 via a nozzle (not shown). The contaminants and water are separated from the air by the filter 40, and stored in the reservoir 10, while the clean air is discharged out via the filter 40 and by action of the motor.

As described above, the conventional wet/dry type vacuum cleaner suctions not only the dry media, such as dust, but also suctions wet media, such as water, and then filters the drawn contaminants and water from the air entrained therein. When the reservoirs 1, 10 (FIGS. 1 and 2) are filled with contaminants and water, the user of the vacuum cleaner separates the respective power head unit 3, 30 from the reservoir 1, 10, empties the reservoir 1, 10 and remounts the same in place.

The problem is that the power head unit 3, 30, each having a motor therein, is mounted on the upper portion of the reservoir 1, 10. Accordingly, the user experiences inconvenience when he/she needs to empty the reservoir 1, 10 because he/she has to remove the power head unit 3, 30, which is quite heavy, from the reservoir 1, 10 in order to empty the reservoir 1, 10.

SUMMARY OF THE INVENTION

Accordingly, it is an object of the present invention to provide an improved wet/dry type vacuum cleaner enabling a user to empty contaminants and water easily from a contaminant receptacle.

The above object is accomplished by a wet/dry type vacuum cleaner according to the present invention, including a suction generating means; a cleaner body comprising the suction generating means at one side of a lower portion, an intake port being connected with a nozzle that is movable along a surface to be cleaned, and a discharge port through which clean air is discharged; a contaminant separating means removably mounted in the cleaner body, for separating a contaminant-laden wet air, drawn through the intake port, into the air component from the contaminant and water component, and then storing the separated contaminant and water therein and discharging the air; a cover disposed on an upper portion of the cleaner body for sealing an upper opening of the cleaner body, the cover being capable of opening and closing; and a discharge path providing fluid communication between the contaminant separating means and the discharge port, for discharging the air separated at the contaminant separating means out through the discharge port of the cleaner body.

The suction generating device is positioned in the lower side of the cleaner body. Accordingly, the cover can have a simple construction, and the user can empty the contaminant receptacle by opening the cover, which is easier when compared to the conventional vacuum cleaner that has the heavy bypass motor in the upper portion of the cleaner body requiring the user first to pull out in order to empty the contaminant receptacle placed therebelow. As a result, user convenience and preference increases.

The suction generating means comprises a bypass motor, and the cleaner body comprises a motor cooling path extending from the lower potion to the side via the bypass motor.

The cleaner body comprises a base comprising a seating portion on which the suction generating means is mounted; an inner receptacle standing upright on the base, the inner receptacle comprising an escape groove for avoiding interference with the suction generating means, and a space in which the contaminant separating means is mounted; and an outer receptacle standing upright on the base, surrounding the inner receptacle.

The intake port is formed at an upper side of the space, and the discharge port is formed at the escape groove, and first and second through holes are formed in the outer receptacle corresponding to the intake port and the discharge port, respectively.

The base comprises a plurality of rollers for enabling movement of the cleaner body, and the inner receptacle may comprise an auxiliary tool space for keeping auxiliary cleaning tools therein.

The contaminant separating means comprises a contaminant receptacle formed in the space of the inner receptacle, the contaminant receptacle comprising a third through hole in fluid communication with the intake port of the inner receptacle; and a filter assembly, removably mounted in the contaminant receptacle, in fluid communication with the discharge path, for filtering out the contaminant and water component from the air being drawn through the intake port.

The contaminant receptacle is formed of a transparent material, and the cleaner body is provided with a transparent window through which the contaminant collected in the contaminant receptacle is visible to the outside.

The cover is pivotally disposed on the upper receptacle by a hinge to permit the cover to open and close by pivoting.

The discharge path comprises a first path formed in the cleaner body in fluid communication with the discharge port; and a second path formed in the cover with one end being connected to the first path and the other end being connected to the contaminant separating means.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF PREFERRED EMBODIMENT

The objects and other characteristics of the present invention will be made more apparent by describing the preferred embodiments with reference to the accompanying drawings.

Figure 1:
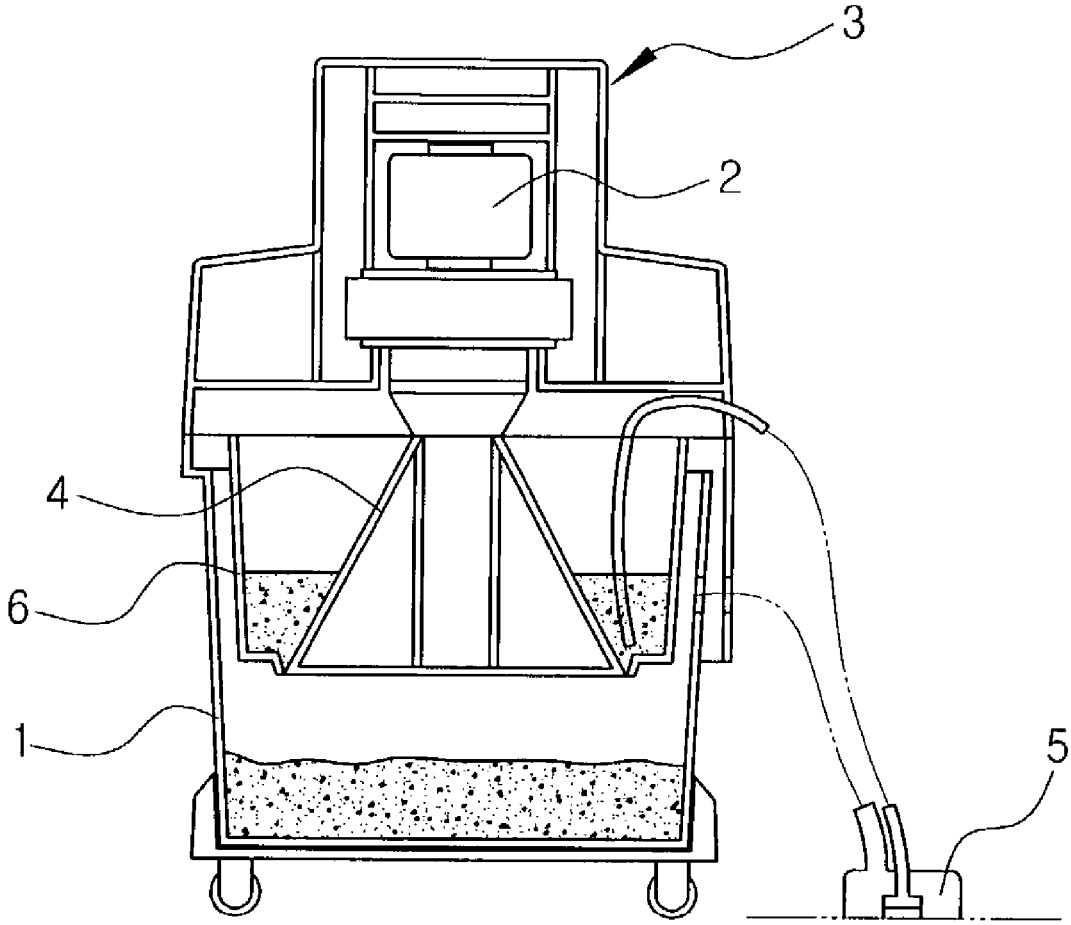
FIG. 1 (PRIOR ART)
FIG. 1 is a cross-sectional view showing one example of a conventional wet/dry type vacuum cleaner.
Figure 2:
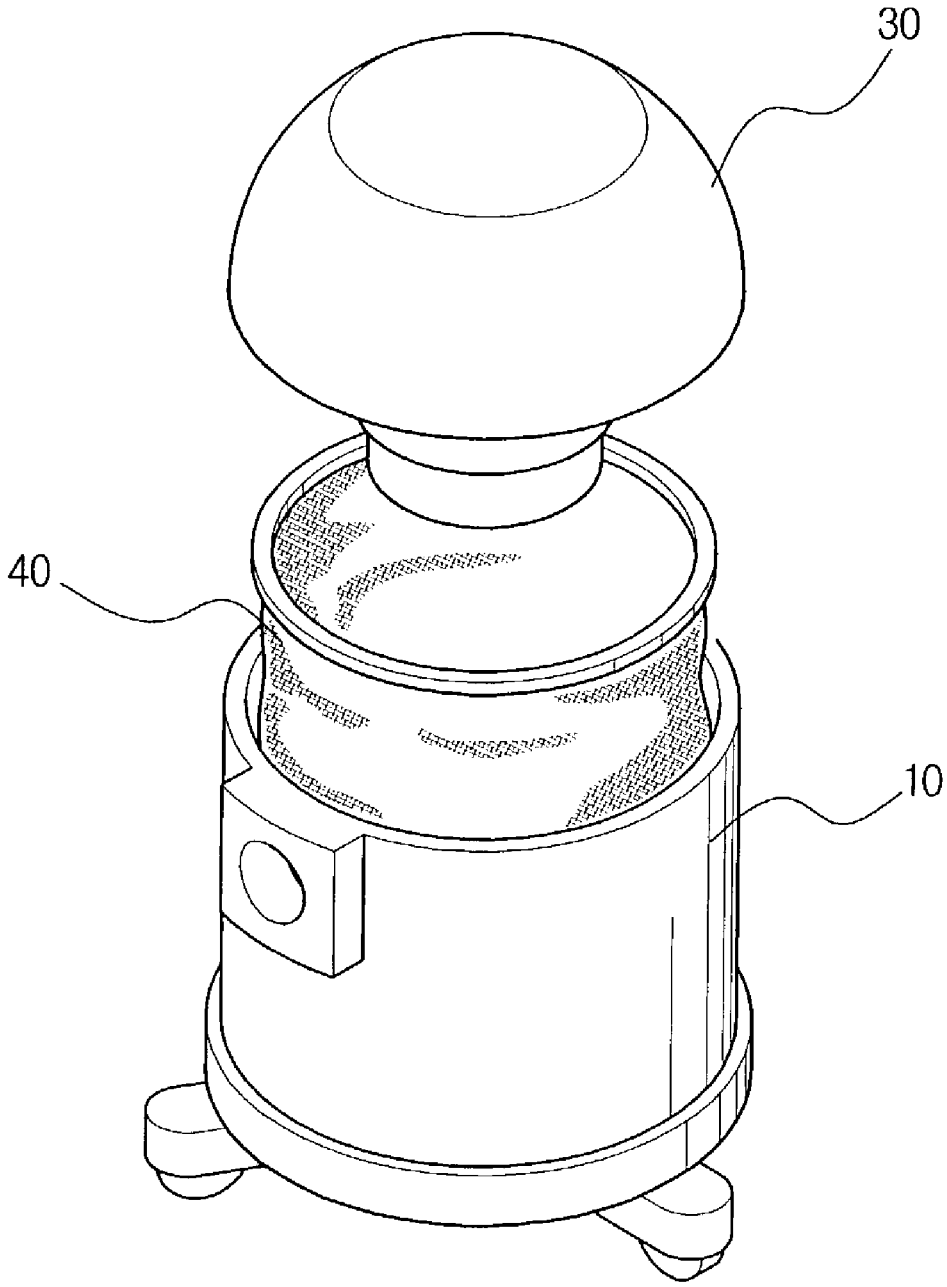
FIG.2 (PRIOR ART)
FIG. 2 is a perspective partially exploded view showing another example of a conventional wet/dry type vacuum cleaner.
Figure 3:
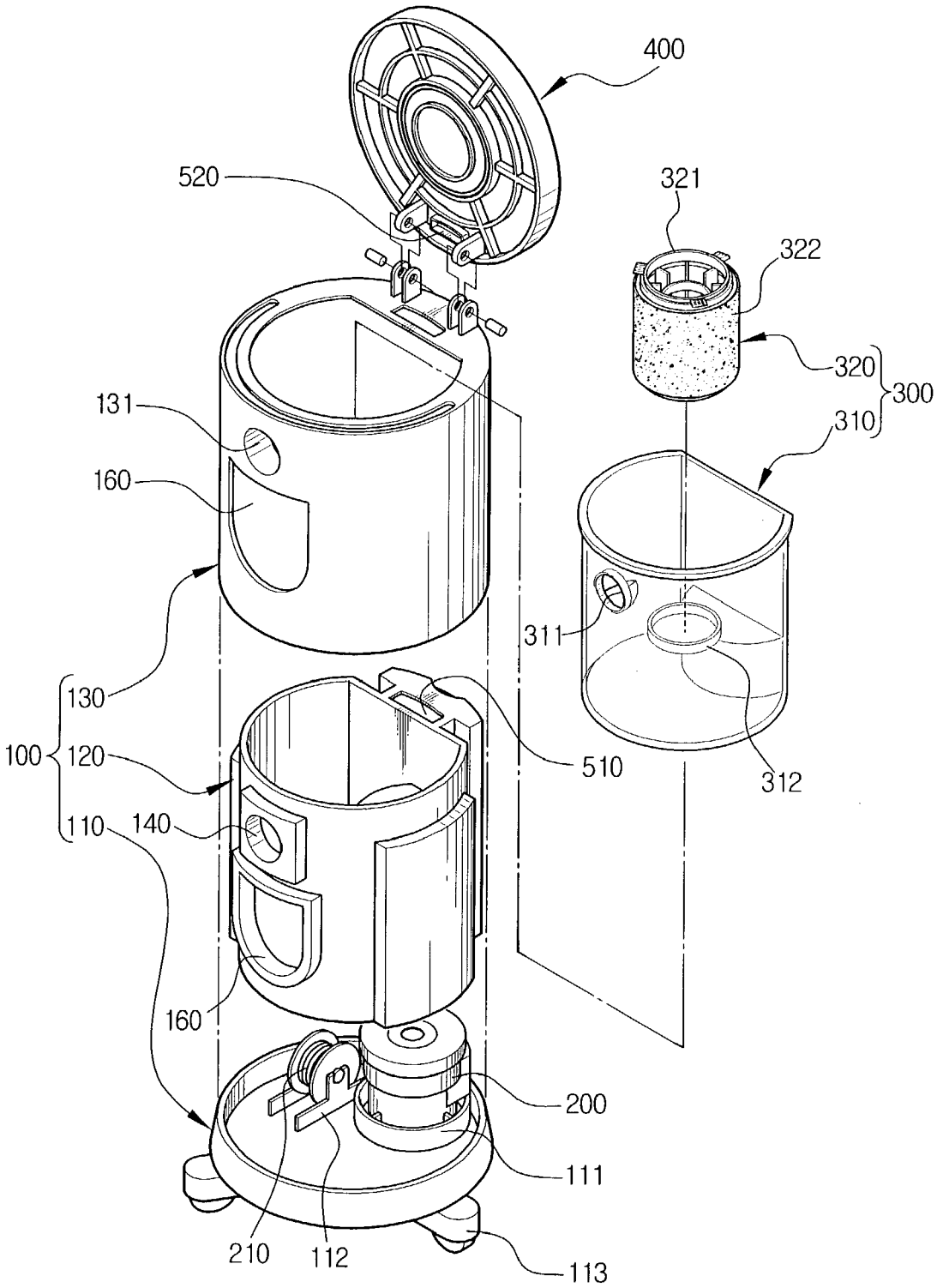
FIG. 3 is an exploded, perspective view showing a wet/dry type vacuum cleaner according to a preferred embodiment of the present invention.
Figure 4:
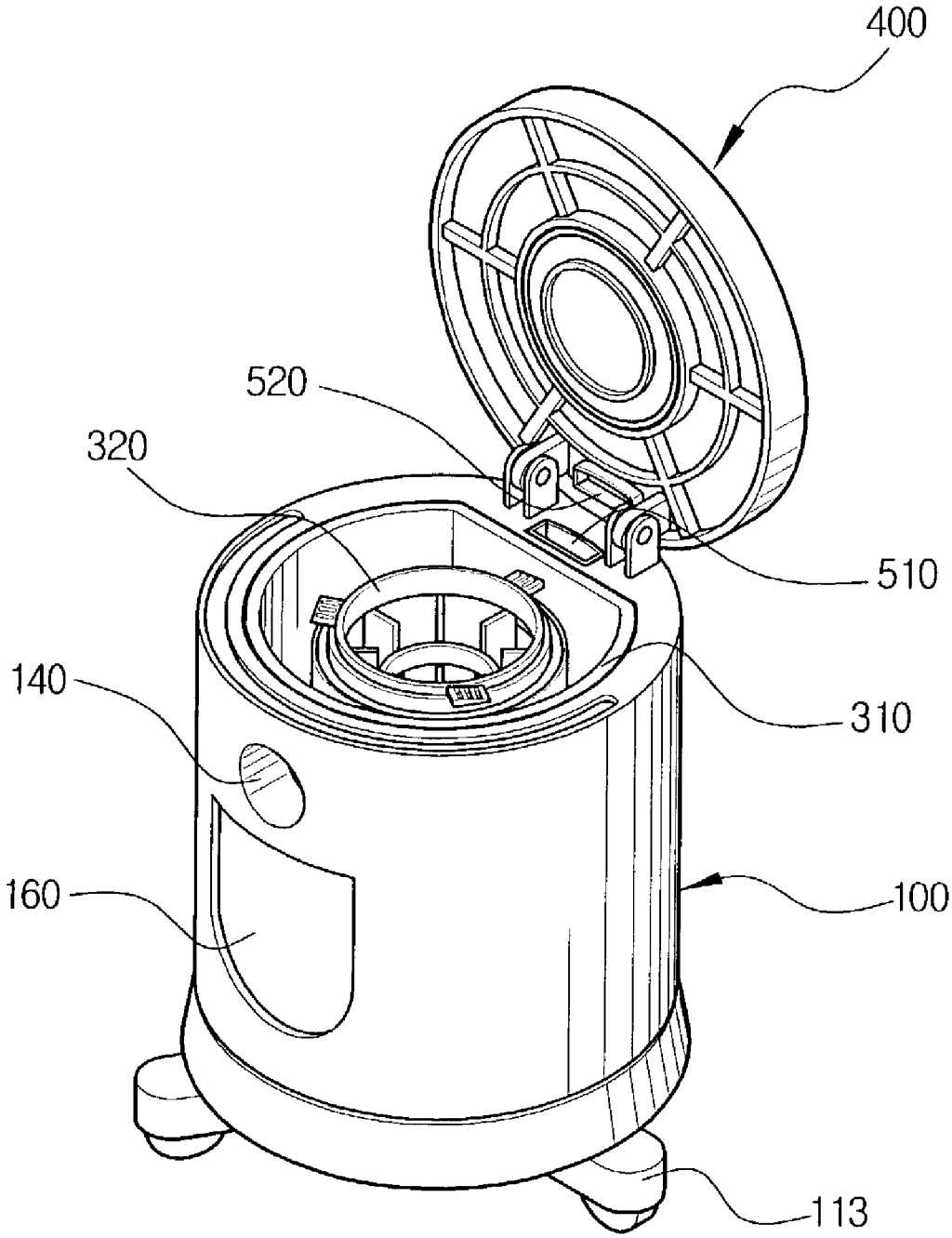
FIG. 4 is a perspective view showing the wet/dry type vacuum cleaner after being assembled with its cover open.
Figure 5:
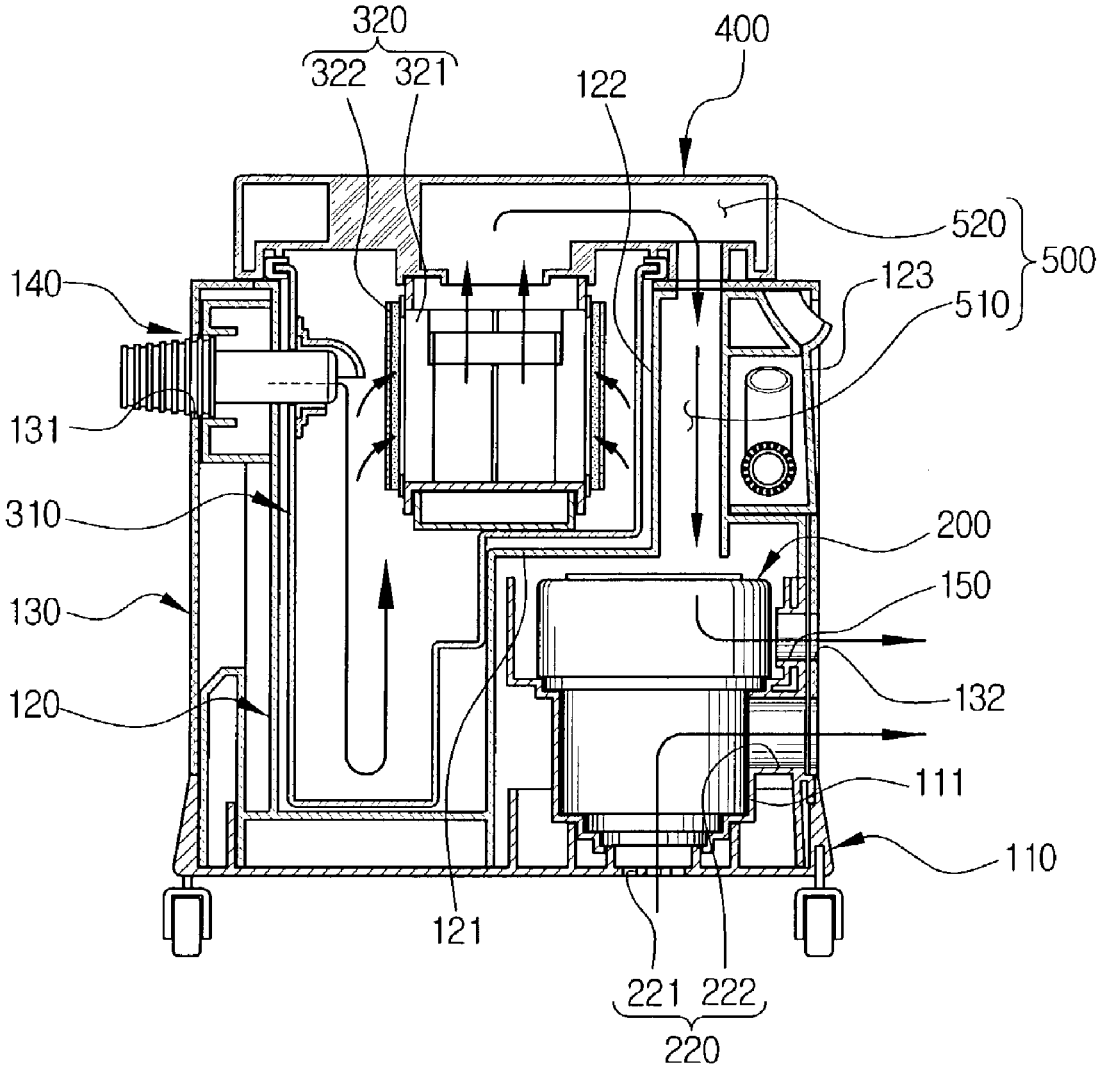
FIG. 5 is a cross-sectional view for illustrating the structure and operation of the wet/dry type vacuum cleaner according to the present invention.

Now referring to FIGS. 3 through 5, the wet/dry type vacuum cleaner according to a preferred embodiment of the present invention includes a cleaner body 100, a bypass motor 200 used as a suction generator, a contaminant separating means 300, a cover 400 and an air discharge path 500 (FIG. 5).

The cleaner body 100 includes a base 110, an inner receptacle 120 and an outer receptacle 130. The cleaner body 100 also includes an intake port 140, which is connected to a nozzle (not shown) for suctioning contaminants and water while moving along a surface to be cleaned, and a discharge port 150 through which clean air is discharged.

The base 110 is formed substantially as a circular plate, and has a flange protruding upwardly to a predetermined height along an outline. The base 110 defines a motor seating portion 111 on which the bypass motor 200 is mounted, and also a cord-reel device seating portion 112 adjacent to the motor seating portion 111, on which a cord-reel device 210 is mounted. Further, the base 110 is provided with a plurality of rollers 113 on the lower surface thereof for enabling easy movement of the cleaner.

The inner receptacle 120 is mounted to stand upright on the base 110. The inner receptacle 120 has an escaping groove 121 (FIG. 5) formed on a lower portion thereof for avoiding interference with the bypass motor 200 and the cord-reel device 210 during the mounting of the inner receptacle 120 with respect to the base 110. The inner receptacle 120 also defines a predetermined space 122 therein, within which the contaminant separating means 300 is removably mounted. The intake port 140 is formed at a predetermined side of an upper portion of the space 122, while the discharge port 150 is formed at the side adjacent the escaping groove 121. The inner receptacle 120 also has an auxiliary tool space 123 for keeping auxiliary cleaning tools therein.

The outer receptacle 130 is also stood upright on the base 110, surrounding the inner receptacle 120. The outer receptacle 130 has through holes 131, 132, respectively, corresponding to the locations of the suction port 140 and the discharge port 150. In the case that an auxiliary tool space 123 (FIG. 5) is formed in the inner receptacle 120, an opening is provided in the outer receptacle 130 for access to the auxiliary tool space 123.

As described above, the bypass motor 200 is also mounted on the base 110. Considering the fact that operation of the bypass motor 200 generates heat, the present invention employs a passage 220 for cooling the bypass motor 200. As shown in FIG. 5, the motor cooling passage 220 is formed as an air outlet 222, which extends through the inner and the outer receptacles 120, 130, to provide fluid communication between an air inlet 221 formed in the lower portion of the motor seating portion 111 and the side of the bypass motor 200. As the bypass motor 200 is driven, air is drawn in through the air inlet 221 and flows toward the outside through the air outlet 222, while cooling the motor 200 disposed in the path of the flowing air.

The contaminant separating means 300 includes a contaminant receptacle 310 and a filter assembly 320. The contaminant separating means 300 separates contaminants and water from the air drawn in through the intake port 140 and collects the separated contaminants and water therein.

The contaminant receptacle 310 is mounted in the space 122 of the inner receptacle 120, and has a through hole 311 that is in fluid communication with the intake port 140. According to this embodiment, the contaminants receptacle 310 is formed of a transparent material, so that a user can check the amount of contaminant collection without necessitating removal of the cover 400. Accordingly, the cleaner body 100 is provided with a transparent window 160 through which the contaminant receptacle 310 is exposed. Further, a filter holder 312 is provided on the inside of the contaminant receptacle 310 for removably securing the filter assembly 320.

Accordingly, the filter assembly 320 is removably mounted in the filter holder 312 of the contaminant receptacle 310. The filter assembly 320 includes a filter frame 321 having a plurality of holes formed therein a radial direction, and a filter member 322, such as a nonwoven fabric disposed on the outer circumference of the filter frame 321. Any contaminants entrained in the air are filtered out by the filter member 322, and the clean air is discharged out through the discharge passage 500. At this time, since the water separated from the air is stored in the bottom portion of the contaminant receptacle 310, reversal of the water through the filter assembly 320 along with the air does not occur. Albeit not shown in detail, there is provided a float in the filter assembly 320. Accordingly, when the level of water at the contaminant receptacle 310 reaches a predetermined limit, the float of filter assembly 320 floats, thereby blocking the discharge passage 500. Accordingly, reverse flow of the water from the contaminant receptacle 310 is prevented.

The cover 400 is pivotally mounted on the cleaner body 100, and more specifically, it is mounted on a side of an upper portion of the outer receptacle 130 by a hinge, so as to seal the upper opening of the cleaner body 100. Albeit not shown, there is a locking device at the opposite side from the hinge for locking and releasing the cover 400 with respect to the cleaner body 100, whose structure and functions will be omitted here as they are generally known. Unlike the conventional case that provides a motor connected to the cover, according to the present invention there is no need to provide the motor connected to the cover 400. Accordingly, the cover 400 can be formed having a simple structure, thereby enabling easier opening and closing.

Air passed through the filter assembly 320 is discharged through the discharge passage 500. The discharge passage 500 includes a first path 510 formed in the inner receptacle 120 of the cleaner body 100 that is in fluid communication with the discharge port 150, and a second path 520 formed on the cover 400. As the cover 400 closes, one end of the second path 520 is connected to the first path 510, while the other end is connected to the filter assembly 320.

Hereinbelow, the operation of the wet/dry type vacuum cleaner constructed according to the present invention will be described in greater detail with reference to FIGS. 4 and 5.

Albeit not shown in FIGS. 4 and 5, a cleaner tool such as a nozzle is connected to the intake port 140 of the wet/dry type vacuum cleaner according to the present invention. As the bypass motor 200 is driven, a strong suction is generated in the contaminant receptacle 310, suctioning the contaminants and water together with the air from the surface where the nozzle is moved along. Accordingly, the contaminants, water and air are drawn into the contaminant receptacle 310 through the intake port 140, and the air is discharged out along the discharge passage 500 and via the bypass motor 200. However, since the contaminants are blocked by the filter member 322 of the filter assembly 320, they are filtered and collected in the contaminant receptacle 310.

Meanwhile, the water is removed from the flowing air because it has a greater density than the air, and is directly stored in the contaminant receptacle 310. Although there a splash of water may arise at the time of suctioning the water, it is also blocked by the filter member 322 of the filter assembly 300 into the contaminant receptacle 310. Since the air circulates along the motor cooling path 220 that is formed via the bypass motor 200, the bypass motor 200 is cooled during the cleaning operation as the air circulates.

The user of the cleaner carries out a cleaning operation on a desired area with the vacuum cleaner operating as described above. Then, at a certain point when the contaminant receptacle 310 is full of contaminants and water, the user empties the contaminant receptacle 310. In order to empty the contaminant receptacle 310, the user simply opens the cover 400 from the cleaner body 100, and then pulls out the contaminant receptacle 310 placed therebelow. Accordingly, the user can empty the contaminant receptacle 310 very easily.

In other words, it was inconvenient for the user of the conventional wet/dry type vacuum cleaner to first pull out the heavy power head unit in order to empty the contaminant receptacle placed therebelow. According to the present invention, since the bypass motor is mounted in the lower portion of the cleaner, the cover can be constructed to serve merely as an opening/closing tool, and the user can easily empty the contaminant receptacle by simply opening the cover without having to first pull out the heavy power head unit.

According to the present invention, as described above, the suction generating device is positioned in the lower side of the cleaner body. Accordingly, the cover construction can be simple, and the user can empty the contaminant receptacle by opening the cover, which is easier when compared to the conventional vacuum cleaner that has the heavy bypass motor in the upper portion of the cleaner body requiring the user to first pull it out in order to empty the contaminant receptacle placed therebelow. As a result, user convenience and preference increases.

Although the preferred embodiment of the present invention has been described, it will be understood by those skilled in the art that the present invention should not be limited to the described preferred embodiment, but various changes and modifications can be made while remaining within the spirit and scope of the present invention as defined by the appended claims.

What is claimed is:

1. A wet/dry type vacuum cleaner, comprising:

a suction generating means; a cleaner body comprising the suction generating means at one side of a lower portion, an intake port, capable of being connected to a nozzle that is movable along a surface to be cleaned, and a discharge port through which clean air is discharged;

a contaminant separating means removably mounted in the cleaner body, for separating contaminant-laden wet air drawn through the intake port into the air component from the contaminant and water component, and then storing the separated contaminant and water therein and discharging the air;

a cover disposed on an upper portion of the cleaner body for sealing an upper opening of the cleaner body, the cover being capable of opening and closing; and a discharge path providing fluid communication between the contaminant separating means and the discharge port for discharging the air separated at the contaminant separating means out through the discharge port of the cleaner body' and a base comprising a seating portion on which the suction generating means is mounted;

an inner receptacle standing upright on the base, the inner receptacle comprising an escape groove for avoiding interference with the suction generating means, and a space in which the contaminant separating means is mounted; and an outer receptacle standing upright on the base, surrounding the inner receptacle, the intake port being formed at an upper side of the space, the discharge port being formed at the escape groove, and first and second through holes being formed in the outer receptacle corresponding to the intake port and the discharge port, respectively.

2. The wet/dry type vacuum cleaner of claim 1 wherein the suction generating means comprises a bypass motor, and the cleaner body comprises a motor cooling path extending from the lower portion to the side via the bypass motor.

3. The wet/dry type vacuum cleaner of claim 1 wherein the base comprises a plurality of rollers for enabling a movement of the cleaner body.

4. The wet/dry type vacuum cleaner of claim 1 wherein the inner receptacle comprises an auxiliary tool space for keeping auxiliary cleaning tools therein.

5. The wet/dry type vacuum cleaner of claim 1 wherein the contaminant separating means comprises: a contaminant receptacle formed in the space of the inner receptacle, the contaminant receptacle comprising a third through hole in fluid communication with the intake port of the inner receptacle; and a filter assembly, removably mounted in the contaminant receptacle, in fluid communication with the discharge path, for filtering out contaminants and water from the air being drawn through the intake port.

6. The wet/dry type vacuum cleaner of claim 5 wherein the contaminant receptacle is formed of a transparent material, and the cleaner body is provided with a transparent window through which the contaminant collected in the contaminant receptacle is visible to the outside.

7. The wet/dry type vacuum cleaner of claim 5 wherein the cover is pivotally disposed on the upper receptacle by a hinge to permit the cover to open and close by pivoting.

8. The wet/dry type vacuum cleaner of claim 1 wherein the discharge path comprises: a first path formed in the cleaner body in fluid communication with the discharge port; and a second path formed in the cover with one end being connected to the first path and the other end being connected to the contaminant separating means.

9. A wet/dry type vacuum cleaner, comprising:

a bypass motor serving as a suction generating means;

a base comprising a seating portion on which the bypass motor is mounted;

an inner receptacle standing upright on the base, the inner receptacle comprising, an escape groove for avoiding interference with the bypass motor, a predetermined space defined therein, an intake port formed on an upper side of the space, capable of being connected to a nozzle movable along a surface to be cleaned and thus drawing in a contaminant-laden wet air from the surface therethrough, and a discharge port through which air is discharged;

an outer receptacle standing upright on the base surrounding the inner receptacle, the outer receptacle comprising first and second through holes in fluid communication with the intake port and the discharge port of the inner receptacle, respectively;

a contaminant receptacle removably disposed in the space of the inner receptacle, the contaminant receptacle comprising a third through hole in fluid communication with the intake port of the inner receptacle;

a filter assembly removably mounted in the contaminant receptacle for filtering out the component contaminant and water from the contaminant-laden wet air as drawn through the intake port;

a cover pivotally disposed on one side of the outer receptacle, sealing an upper opening of the outer receptacle, the cover being pivoted from an open position to a closed position; and a discharge path for opening a fluid communication between the filter assembly and the discharge port, thereby permitting the air separated at the filter assembly to be discharged out through the discharge port, comprising a first path formed in the inner receptacle in fluid communication with the discharge port, and a second path, formed in the cover, for connecting the first path and the filter assembly.

* * * * *